US006474589B1

(12) United States Patent
Enwald et al.

(10) Patent No.: US 6,474,589 B1
(45) Date of Patent: Nov. 5, 2002

(54) CHANGE DEVICE OF A REEL-UP AND METHOD FOR CHANGING A ROLL

(75) Inventors: Petri Enwald; Pauli Kytönen, both of Tuusula; Seppo Luomi, Järvenpää, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/555,657

(22) PCT Filed: Dec. 1, 1998

(86) PCT No.: PCT/FI98/00937

§ 371 (c)(1),
(2), (4) Date: Aug. 1, 2000

(87) PCT Pub. No.: WO99/28227

PCT Pub. Date: Jun. 10, 1999

(30) Foreign Application Priority Data

Dec. 1, 1997 (FI) ..... 974387

(51) Int. Cl.[7] ..... B65H 18/16; B65H 19/26; B65H 19/28

(52) U.S. Cl. ..... 242/527.2; 242/527.3; 242/527.4; 242/532.2; 242/532.3; 242/542.3

(58) Field of Search ..... 242/527.2, 527.3, 242/527.4, 532.2, 532.3, 542.3

(56) References Cited

U.S. PATENT DOCUMENTS

| | | | | | |
|---|---|---|---|---|---|
| 2,537,588 | A | * | 1/1951 | Husson | 242/532.2 |
| 3,527,424 | A | * | 9/1970 | Goldman | 242/532.2 |
| 3,539,125 | A | * | 11/1970 | Patriksson | 242/532.2 |
| 3,642,221 | A | | 2/1972 | Hellemans | |
| 3,743,199 | A | * | 7/1973 | Karr et al. | 242/532.2 |
| 3,844,189 | A | | 10/1974 | Jardine | |
| 3,908,924 | A | * | 9/1975 | Schulze | 242/532.2 |
| 4,147,287 | A | | 4/1979 | Reba | |
| 4,196,865 | A | * | 4/1980 | Patriksson | 242/532.2 |
| 4,445,646 | A | * | 5/1984 | Karr et al. | 242/542.3 |
| 4,456,190 | A | * | 6/1984 | Karttunen et al. | 242/532.2 |
| 4,601,441 | A | * | 7/1986 | Oinonen et al. | 242/532.2 |
| 4,695,004 | A | | 9/1987 | Grossmann et al. | |
| 5,022,597 | A | | 6/1991 | Morizzo | |
| 5,318,237 | A | | 6/1994 | Lotto et al. | |
| 5,328,136 | A | | 7/1994 | Müller et al. | 242/541.3 |
| 5,988,557 | A | | 11/1999 | Möller et al. | 242/532 |
| 6,029,927 | A | * | 2/2000 | Wohlfahrt et al. | 242/532.2 |

FOREIGN PATENT DOCUMENTS

| | | |
|---|---|---|
| DE | 3708891 | 11/1987 |
| DE | 19542096 | 10/1996 |
| GB | 2126974 | 4/1984 |
| GB | 2146303 | 4/1985 |
| WO | 9425382 | 11/1994 |
| WO | 9611868 | 4/1996 |

* cited by examiner

*Primary Examiner*—John M. Jillions
(74) *Attorney, Agent, or Firm*—Steinberg & Raskin, P.C.

(57) ABSTRACT

A change device of a reel-up in placed in the reel-up of a paper web in connection with the reel spool (2) forming the core of a new roll and located against the web (W) running onto the old roll (R). The change device comprises a guiding device (3) which is provided with nozzles or the like which are positioned and directed with respect to the reel spool (2) in such a way that they direct air jets (S) to the new end of the web following the cut-off point of the web (W) substantially over the full width of the web, to guide the web around the reel spool (2).

22 Claims, 5 Drawing Sheets

CHANGE DEVICE OF A REEL-UP AND METHOD FOR CHANGING A ROLL

FIELD OF THE INVENTION

The present invention relates to a change device for a continuously operating reel up of a paper machine, the change device being arranged in connection with a reel spool which functions as the core for a new roll of paper. The present invention also relates to a method for changing a roll in a continuous reel-up of a paper machine.

BACKGROUND OF THE INVENTION

In the reel-up for a paper web, in a so-called Pope-type reel-up, or a centre-drive-assisted Pope-reel, the ready-made paper is reeled after the calender around a reel spool (reeling drum). The reeling itself is conducted in such a way that the reel spool is loaded against a reeling cylinder over which the web to be reeled travels, winding around the reel spool to form a complete roll or reel.

Also this section of the paper machine has to operate in a non-stop manner and receive the continuous paper web passed from the preceding sections of the paper machine. Thus, when the old roll is complete, the web has to be cut off, after which the next stage is to start winding the web following the cut-off point around a new reel spool. In practice, this takes place in such a way that when the paper reel has reached its full size, a new empty reel spool, i.e. a reeling drum is moved to the surface of the reeling cylinder in contact with the paper web, and after that the paper web is cut off in a suitable way, and the web end following the cut-off point is guided onto the circumference of the empty reel spool, on which a new roll starts to accumulate.

The most critical stages of the reeling are the cutting off of the paper web and bringing the new end of the web around the empty reel spool. In order to avoid excess broke, the change has to take place without problems. In an ideal case, the new end of the web is brought immediately neatly against the circumferential surface of the empty reel spool. As is well known, there are several ways for conducting the cutting and the exchange, depending on the grammage. One way is to utilize the speed difference between the complete paper reel and the reeling cylinder to produce a web loop, which is guided to the empty reeling drum, whereupon the web is broken. Another method is to feed a special cutting ribbon in the nip between the reeling cylinder and the empty reeling drum, wherein it, when entrained by the reeling drum, simultaneously cuts off the web coming to the reeling cylinder and guides the new end of the web around the reeling drum. The exchange of the roll can also be conducted by cutting the web after the nip between the reeling cylinder and the empty reeling drum, for example by means of an air blowing and by guiding the web around the reeling drum.

At present, paper machines generally run at the speed of 20 m/s or faster, and the aim is, of course, to attain even higher speeds. The cutting of a fast running web is not a problem as such, and the forces due to the speed can even be utilized in the cutting. The critical point is to bring the end of a new web immediately against the circumferential surface of the reeling drum and to make it follow the surface at a high peripheral speed and to prevent the web from wandering in an uncontrolled manner or being displaced on the reeling drum. This problem becomes worse when the grammage is increased.

OBJECTS AND SUMMARY OF THE INVENTION

The purpose of the present invention is to provide a reliable change device of a reel-up, suitable for changing a roll especially at high running speeds of the web and/or with heavy paper grades. In an advantageous manner, according to the invention, the web wound on the reeling drum is subjected to air jets substantially over the full width of the web, which air jets guide the web around the machine reel and also act within a sector of suitable size to bring the web around this reeling drum. The air jets are advantageously generated by providing the guiding device according to the invention with air jet nozzles. In this way it is possible in a contactless manner to guide the leading end of the web, winding on a new reeling drum, in an area of a predetermined length in the circumferential direction, until the web is wound sufficiently around the reeling drum so that the web will follow this leading portion and wind around the reeling drum, starting to form superimposed layers.

The air jets can for example be positioned and directed in such a way that they press the web against the surface of the reeling drum and are effective within a sufficiently long sector in order to hold the web against the surface of the reeling drum, or they guide the web along a web guide surface arranged to guide the web around a new reeling drum. The flow rate of the air jets is adjustable, and it can be advantageously adjusted at least as high as the production rate of the machine, i.e. the travel speed of the web.

The method of present invention relates to a method for changing a roll in a continuous reel-up of a paper web, in which the web running onto an old roll is cut off and is guided onto a reel spool forming the core of the new roll, the leading end of the web being guided onto the reel spool by means of airjets.

The travel of the leading end following the cut-off point of the web can be guided in various ways by means of air jets effective substantially over the full width of the web opposite to the reeling drum.

BRIEF DESCRIPTION OF THE DRAWING

In the following, the invention will be described in more detail with reference to the appended drawings, in which.

DETAILED DESCRIPTION OF THE INVENTION

Figure 1:
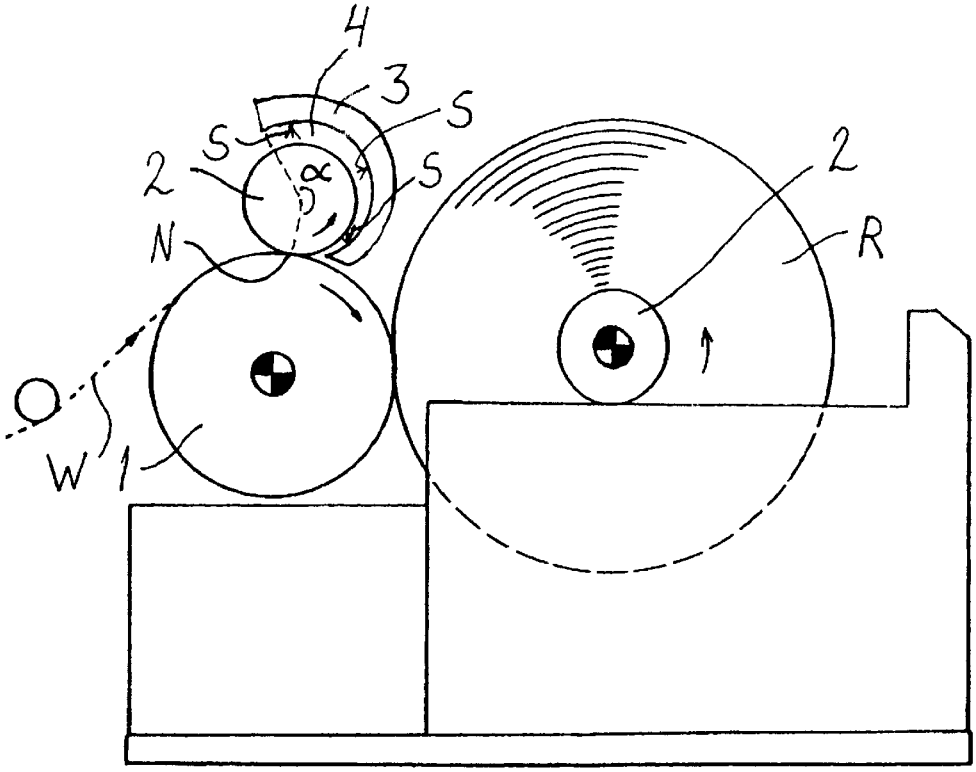
FIG. 1 shows a side view of a reel-up, in which the change device according to the invention is used.

FIG. 1 shows schematically a continuously operating reel-up, a so-called Pope-reel, which continuously forms paper rolls, machine reels with the weight of several tons, from a full-width paper web W coming from the preceding machine sections in a paper machine or the like, one of the complete paper rolls being indicated with the letter R in the figure. The rotating reeling cylinder 1, i.e. the Pope-cylinder, guides the web W onto the roll R, which is loaded in the radial direction against the reeling cylinder 1 on the other side of the reeling cylinder when viewed in the travel direction of the web. The loading takes place with the loading devices known as such, which are not shown. The roll R is centre-driven, i.e. the reeling drum 2 around which the roll R is accumulated, is equipped with a drive. In the travel direction of the web W before the complete R, a new reeling drum 2 to be called reel spool hereinbelow and constituting the core of the following roll, has been brought against the mantle of the reeling cylinder 1. At this stage, for short period of time, the web W still runs onto the roll R to be reeled through a nip N between the new reel spool 2 and the reeling cylinder 1.

The purpose of the exchange is to move the web W that is in contact with the reel spool 2 onto the mantle surface of the reel spool that has been free of the web before the exchange to follow the surface of the reel spool 2 after the cut-off point. To accomplish this, a guiding device 3 is positioned after the nip N between the reel spool 2 and the reeling cylinder 1 in the travel direction of the web W, the device being located opposite to the free mantle following the nip N on the reel spool 2, and thus, viewed in the travel direction of the web W, behind the reel spool 2 and at least partly above the same. From the guiding device 3, air jets S are directed suitably to guide the web around the reel spool 2. The air jets S are positioned in such a way that they are effective substantially throughout the width of the reel spool which receives the full-width web W, and in a sufficiently long sector after the nip N in the direction of rotation of the reel spool 2. Thus, the air jets S are directed to the substantially full-width fresh end of the web after the cut-off point of the web W, substantially throughout the full width of the web. The air jets can be for example spot-like or slot-like in such a way, however, that their range of action is advantageously the full width of the web W.

Figure 2:
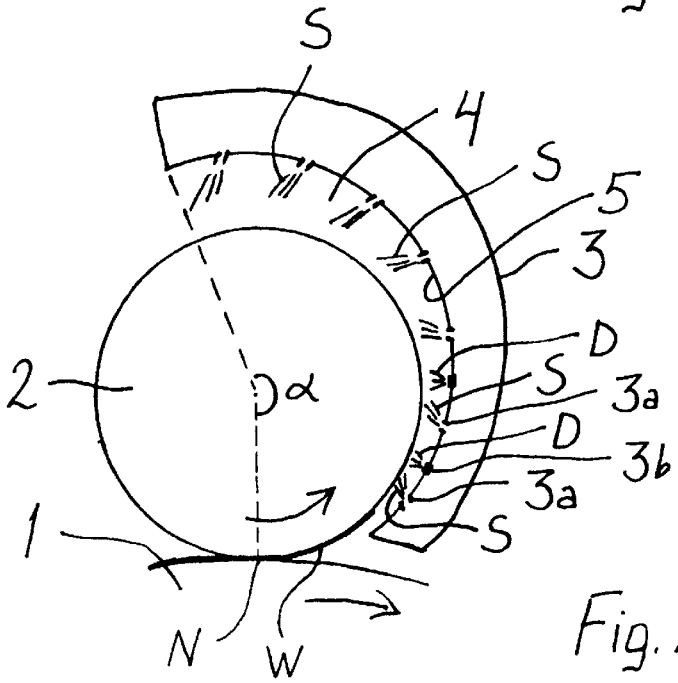
FIG. 2 shows the change device of a reel-up in a larger scale in an exchange situation.

The guiding device 3 is located opposite to the circumferential surface of the reel spool 2 that is free before the exchange. As shown in FIG. 1, the side of the guiding device 3 facing the circumferential surface of the reel spool 2 can be curved and correspond to the curvature of the periphery of the reel spool 2. The device can be a plate, a surface, or a box-like structure, leaving a space 4 between its surface 5 located opposite to the circumferential surface of the reel spool 2 and the circumferential surface of the reel spool 2. This space 4 is closed at least in the radial direction, and the air jets S directed from the surface 5 towards the circumferential surface of the reel spool in the space generate an overpressure which presses the web W against the mantle of the reel spool 2 (FIG. 2). This space 4 is located in a sector a of a suitable length around the reel spool 2 after the nip N.

The air jets are generated by means of nozzles 3*a*, shown in FIG. 2, which open on the surface 5 of the guiding device 3. The effect of the nozzles extends substantially over the full width of the reel spool 2, and in the direction of the periphery of the reel spool 2, there is a sufficient number of them placed one after the other. The nozzles can be, for example, nozzle slots or nozzle orifices arranged one adjacent to the other in the cross-machine direction. The nozzles can be set next to each other at suitable distances in order to distribute the effect in the lateral direction. To produce the air jets S, air is supplied to the nozzles from a suitable pressurized air source. Thus, the guiding device 3 can be a box whose interior is connected to the nozzles 3*a* in order to distribute the air inside the box into separate air jets S and whose wall forms the surface 5 opposite to the circumferential surface of the reel spool 2. It is, however, possible to arrange the nozzles as structures separate from each other in the same guiding device 3, wherein they constitute a structure movable in one entity.

Furthermore, it is possible to provide the guiding device 3, at least in its initial end, i.e. straight after the nip N, with liquid sprays, for example water sprays, which are illustrated by arrows D. The purpose of these is to wet the leading end of the web, pressed against the surface of the reel spool 2 by the air jets S, wherein the leading end of the web adheres better to the surface of the reel spool. Corresponding liquid spray nozzles, indicated in FIG. 2 with the reference numbers 3*b*, can be equipped with an air and water supply of their own, or it is possible that they are provided with the air required in the spraying by the same supply as the nozzles 3*a*, e.g. from inside the box-like guiding device 3. Also the water sprays D are directed towards the surface of the reel spool 2, substantially over the full width of the web W. Furthermore, it is possible that the water sprays D are provided on the same length as the air jets S in the direction of rotation of the reel spool.

The sector a in which the guidance of the web around the reel spool 2 is started and in which there is a closed space 4 between the reel spool 2 and the surface 5 of the guiding device 3 has to be sufficiently long so that the force guiding the web W around the circumferential surface of the spool would be effective within a sufficiently long way on the circumference of the reel spool 2. The length of this sector, measured from that point onwards at which the leading end of the web deviates from the previous direction of the web and starts to run along a new running path around the reel spool 2, in the example of FIG. 2 from the nip N onwards, is advantageously at least 120°, more advantageously at least 150°, most advantageously at least 180°. The closed space 4 can be entirely closed in the radial direction, or it can contain intermediate points which are open outwards in the radial direction in the case the guiding device 3 consists of parts connected to each other successively in the circumferential direction and/or in the axial direction of the reel spool.

If the guiding device 3 does not form a closed space 4, but it contains separate nozzles 3*a* at suitable intervals in the peripheral direction, the area in which the nozzles 3*a* are located should be sufficiently long as well. The length of the sector specified in the aforementioned way, starting from the initial point of the new travel path of the web and ending in the last nozzles, is advantageously at least 120°, more advantageously at least 150°, and most advantageously at least 180°.

The guiding device 3 can be moved to a guiding position by means of a suitable actuator and mechanism, for example from the side in the cross machine direction or from above the reeling cylinder. In both cases, the mechanisms with the associated actuators can be arranged in the frame of the reel-up. The structure following the periphery of the reel spool 2 in a curved configuration can be rigid, or it can also consist of successive parts articulated together in the circumferential direction, which parts can be turned around the reel spool 2 by own actuators of the guiding device 3 when shifted into the guiding position. These successive parts can be for example blow boxes with nozzles of their own.

However, the guiding device is advantageously fixed in such a way that its motion can be functionally integrated with the motion of the reel spool. Thus, the guiding device can be fixed to the device for initial reeling, which is a part of the reel-up frame.

The exchange takes place when the surface speed of the reel spool 2 is at the production speed of the paper web, which is typically at least 500 m/min. The production speeds of the paper web in fast-running machines exceed 1000 m/min, and at the highest they already approach the value of 2000 m/min.

Figure 3:
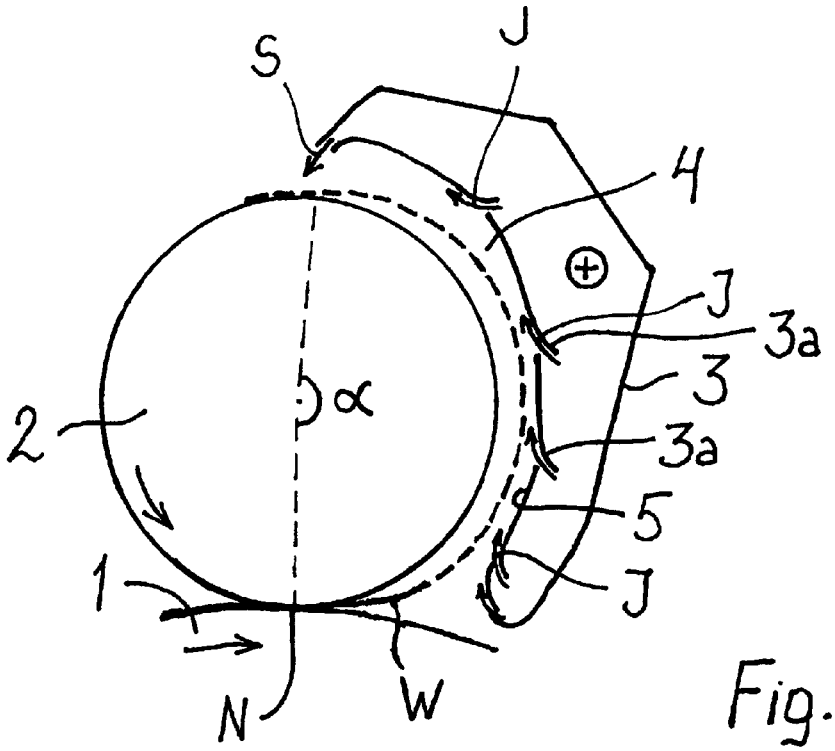
FIG. 3 shows a second embodiment of the change device.

FIG. 3 shows a second preferred embodiment, in which the new end of the web W, following the cut-off point, is substantially over the full width of the web subjected to air jets J which guide the web substantially along a guide surface 5 according to the invention, located opposite to the circumferential surface of the reel spool 2 and arranged to guide the web W around the new reeling drum, i.e. reel spool 2. In the embodiment according to FIG. 3, the guiding device 3 comprises a combination of one or more air jets J and a so-called carrier surface 5, wherein it is provided with one or more web guide jets/surfaces utilizing the so-called Coanda effect, due to the nozzles 3*a* which open to the guide surface and are composed in such a way that the jet J passed through them starts to follow the guide surface 5. Furthermore, as a result of the jets J being directed in a suitable way, a reduced pressure zone is developed in the area after the nip N, which zone guides the web around the reel spool. Advantageously, at least the first air jet row of jets J in the direction of rotation of the reel spool is arranged in such a way that the jet is directed substantially in the travel direction of the circumferential surface of the reel spool 2, and the last jet S is arranged in such a way that the jet is directed substantially towards the reel spool 2, thereby guiding the web W onto its surface. In the guiding device 3 of FIG. 3, a dashed line illustrates one possible travel path of the leading end of the web in the exchange situation.

Figure 4:
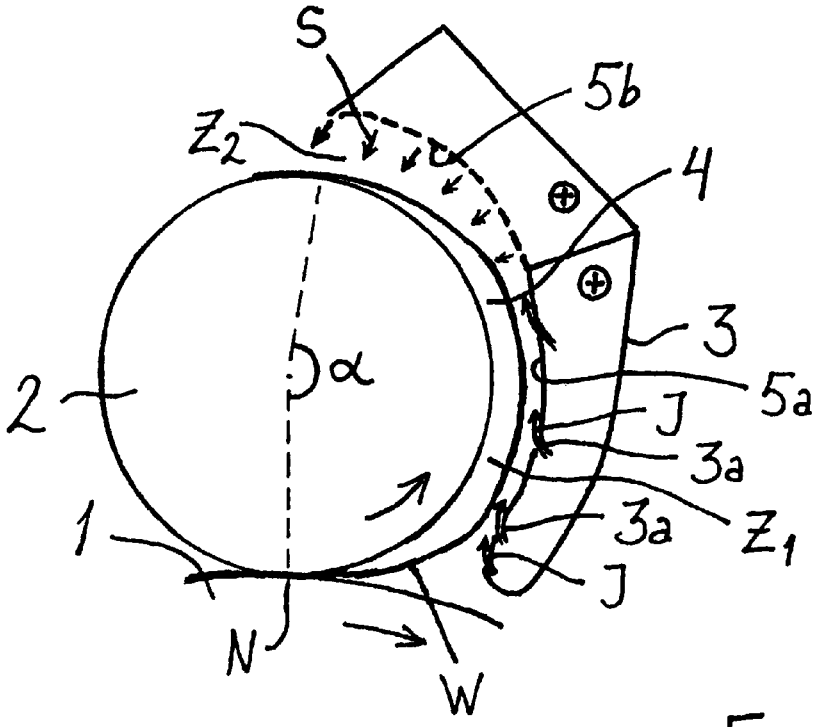
FIG. 4 shows a third embodiment of the change device.

FIG. 4 shows an embodiment, in which the guiding device 3 is constructed in such a way that it comprises two different jet zones $Z_1$, $Z_2$. In this embodiment, in the direction of rotation of the reel spool 2, the nip N is first followed by a so-called Coanda zone $Z_1$, which, according to the operating principle of the device in FIG. 3 conveys the web by means of air jets J along the carrier surface 5*a* to the next zone $Z_2$, in which the web is pressed against the surface of the reel spool 2 by means of air jets S directed substantially towards the surface. Here, the air jets S are produced by means of a suitable plate provided with orifices and forms a surface 5*b* opposite to the surface of the reel spool 2, for example by means of a perforated plate. In this embodiment, the velocity of the jet can be separately adjusted in each zone, and as can be seen in the figure, such a guiding device 3 can also be arranged to form a blow box structure, in which each zone is provided in a separate compartment supplied with pressurized air.

The exchange of the new reel spool can be implemented in the following way. When the new reel spool 2 has been accelerated to a suitable peripheral speed and lowered against the web W which is still running on the reeling cylinder 1 onto the old roll R the guiding device 3 is brought to the guiding position, and the air jets S, J are switched on. After this, the web W is cut by means of a suitable cutting method so that, after the nip N, the leading end of the web W runs with its full width around the circumferential surface of the new reel spool 2, either pressed by the air jets S against the circumferential surface or by means of the air jets J and guided by the bearing surface 5, and it stays thereon by the effect of the air jets S, J, which at the same time operate over the full width. Straight after the cutting, it is possible to start the water sprays D, and they can operate for a shorter period of time than the air jets. When the leading end of the web has wrapped a full revolution around the reel spool 2, the air jets S, J and water sprays D can be switched off, and the guiding device 3 can be moved into a rest position, in which it does not interfere with other functions, such as trasfer of the new reel spool 2, which continuously gathers the web W around itself, in the direction of rotation of the reeling cylinder along its circumference behind the reeling drum, in which position it will be completed during the reeling.

Figure 5:
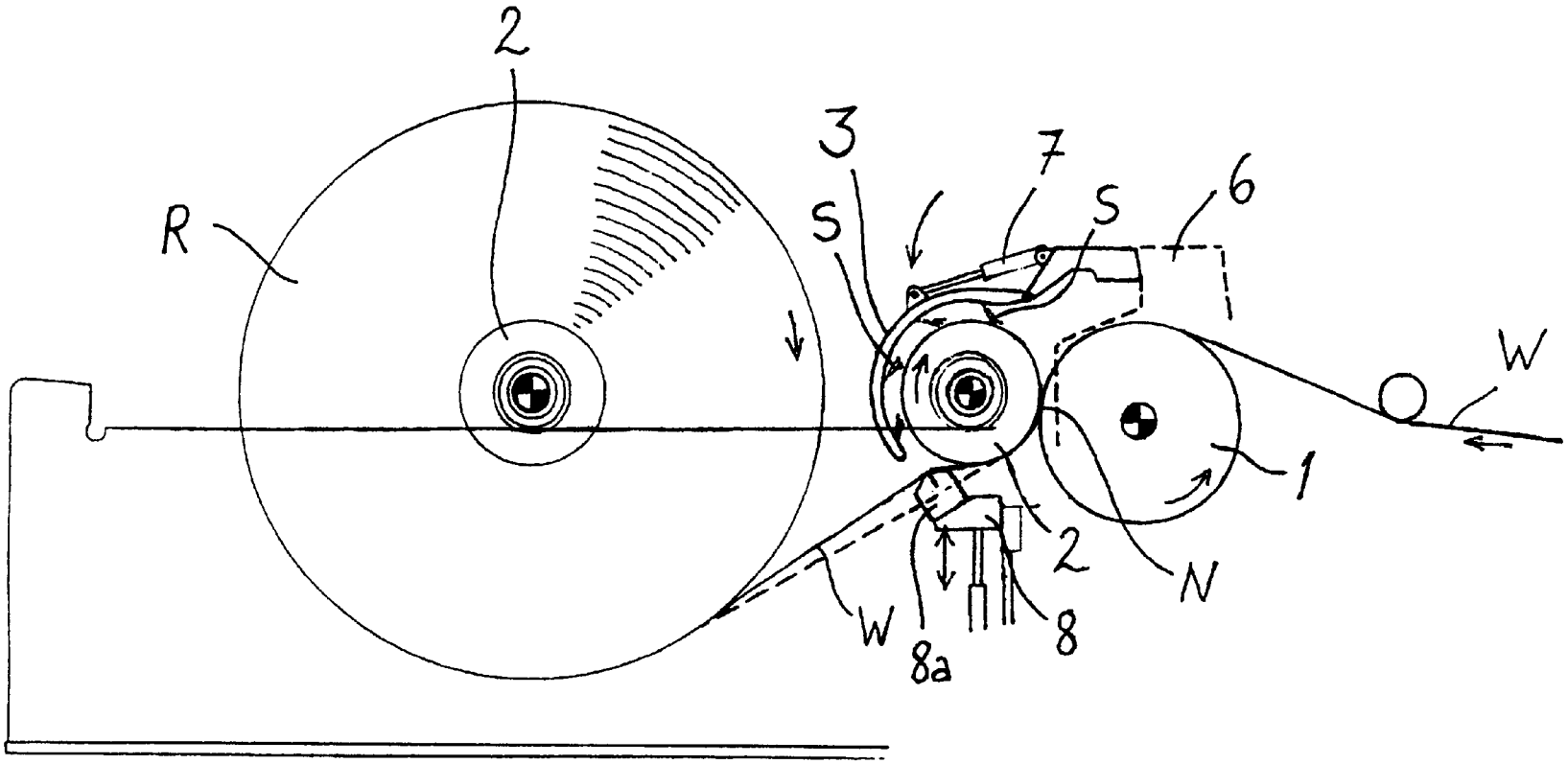
FIG. 5 shows, in a side view of the reel-up, an advantageous way of fixing the change device to the reel-up and an advantageous manner of cutting off the web.

FIG. 5 shows an embodiment according to the invention of a guiding device ready for a roll exchange. The guiding device 3 is articulated in a movable manner in the support means, which are fixed in the device 6 for initial reeling, to which a new, empty reel spool 2 is brought before the roll exchange and by means of which the reel spool is moved to a change position. In the figure, the guiding device is turned by means of an actuator 7, in the plane substantially perpendicular to the axis of the reel spool 2, into the change position, and the full-width cutting device 8 of the web is ready to operate. Before the situation shown in the figure, the roll R which is becoming complete has been moved further from and off the reeling cylinder 1, and the new reel spool 2 has been brought in contact with the web W by means of the device 6 for initial reeling. In this situation, the web W travels a short distance after the nip N on the circumferential surface of the reel spool and leaves the circumferential surface to be directed straight towards the roll R. The cutting device 8 is advantageously movable to the vicinity of the web between the reel spool 2 and the roll R, and away from the vicinity of the web. The guiding device 3 can be e.g. of any of the types shown in FIGS. 2–4, and the placement of the nozzles and the effect of the air jets can be any of those shown in connection with the same. The guiding device 3 is located opposite to the circumferential surface of the reel spool 2, on the side of the sector of the reel spool 2 which is free before the exchange, i.e. in the direction of rotation of the reel spool after the point in which the web W leaves the reel spool 2 for the roll R.

In the exchange situation of FIG. 5 in particular, the cutting device 8 is a cutting device which acts from the side of the web W opposite to the guiding device and cuts off the web W in the area in which the web W travels apart from the reeling cylinder 1 onto the old roll R. The web W is directed from the circumferential surface of the reel spool 2 onto the roll R. Thus, due to the effect of the force directed to the web already before or during the cutting, it is possible to bring the new end of the web closer to the circumferential surface of the reel spool 2, or closer to the transverse inlet gap between the circumferential surface and the guiding device 3. The cutting off of the web W takes place advantageously in such a way that the cutting movement is directed towards this gap and/or towards the circumferential surface of the reel spool 2.

The cutting device 8 is preferably a device that effects a full-width cross-cutting and affects the web W to produce a full-width tear or cut in the area between the circumferential surface of the reel spool 2 and the guiding device 3. Even though, especially with thin paper grades, this can be achieved by means of blowings to generate a clean cut-off point, it is advantageous to use a blade cutter which cuts off the web W in its full width with one stroke. FIG. 5 shows a striking blade cutter which is brought in contact with the web W from underneath in such a way that its blade holder 8*a* touches the web W, thereby using its curved guide surface to deflect the portion of the web which is directed from the reel spool 2 to the roll R, closer to the inlet gap and at the same time closer to the circumferential surface of the reel spool 2. Subsequently, a wide cutting blade which can be moved by actuators, e.g. pneumatic actuators, emerges from inside the blade holder 8*a* and cuts the web W travelling on the guide surface with a quick stroke directed to the lower surface of the web.

It is also possible that the blade cutter 8 is not brought into contact with the web by means of the blade holder 8*a* before the cutting, but the blade strikes across the freely running web. However, also in this case it is possible to deflect the straight run of the web with a separate guide surface to be closer to the inlet gap and the circumferential surface of the reel spool 2.

Figure 6:
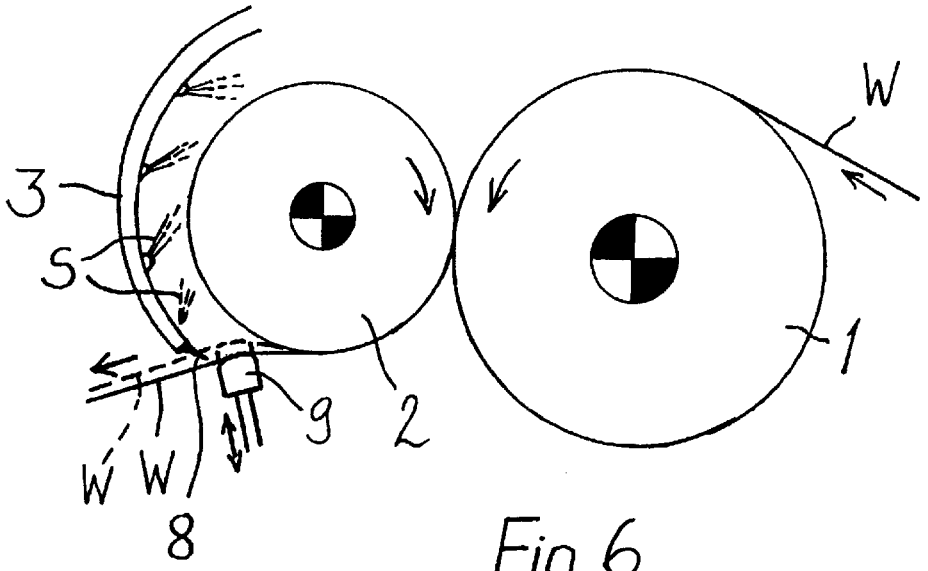
FIG. 6 shows a second embodiment of the change device of FIG. 5.

FIG. 6 shows an arrangement according to FIG. 5, which differs from the arrangement of FIG. 5 in that the cutting takes place on the same side of the web W where the guiding device 3 is located. As for the placement and effect of the nozzles 3*a*, the structure of the guiding device 3 is any of those presented above, but the same structure that supports the nozzles is also provided with a cutting device 8. The cutting device is a stationary cutting blade which extends over the width of the web and is attached to the tip of the guiding device 3 that is directed towards the web. The cutting edge of the blade is directed against the travel direction of the web in such a way that an acute angle is formed between the direction of action of the cutting edge and the run of the web on the departing side of the web. On the opposite side of the web, approximately in the same position as in FIG. 5, i.e. to deflect the web W leaving the reel spool 2 towards the guiding device 3, a separate deflector device 9 is placed, which, in the same way as in the embodiment of FIG. 5, can be moved into a functional position against the web W and off the web W, i.e. it can be moved back and forth by means of a suitable actuator. The point of contact, at which the deflector device 9 with its curved guide surface guides the web, is, in the travel direction of the web located before the point of action of the cutting blade. With the device 9, the web is deflected so high up towards the tip of the guiding device 3 that the web W touches the cutting blade located at the tip of the guiding device 3, wherein the web breaks off and is guided between the guiding device 3 and the mantle surface of the reel spool 2.

Figure 7:
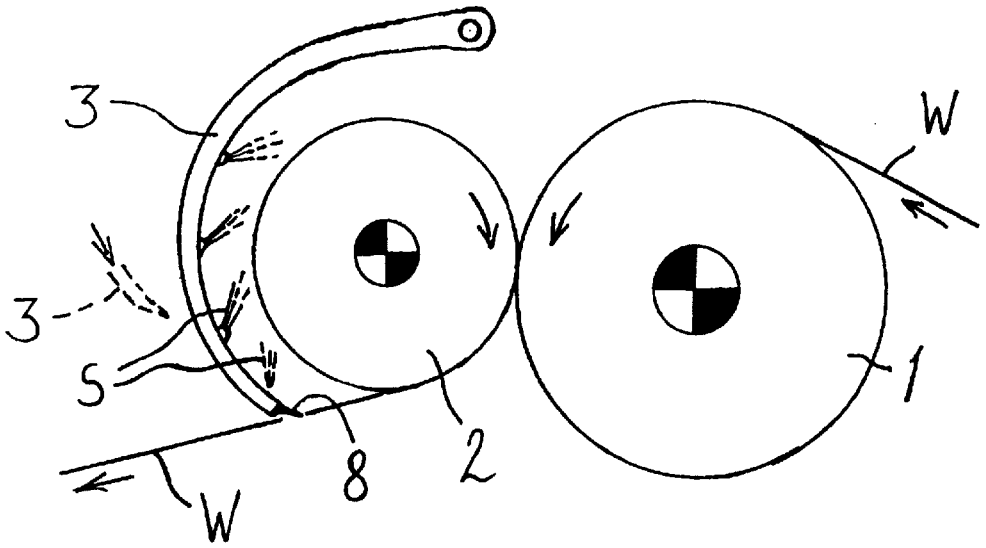
FIG. 7 shows a third embodiment of the change device of FIG. 5.

FIG. 7 presents an alternative in which the cutting method resembles that of FIG. 6, i.e. the blade that cuts the web is located on the same side of the web W as the guiding device 3. Here, the web W is brought in contact with the cutting blade situated at the free end of the guiding device 3 by moving the guiding device 3 towards the web W, i.e. the guiding device 3 is turned downwards until the blade hits the web, the web is broken off, and the new edge following the cut-off point of the web will be automatically passed in full width into the space between the guiding device 3 and the mantle of the reel spool 2. By means of the actuator 7 of FIG. 5, the guiding device can be turned in a plane substantially perpendicular to the axis of the reel spool 2 to the change position, and further so far that the cutting blade reaches the web.

The combination of the embodiments of FIGS. 6 and 7 is also possible, in other words, the deflector device 9 can be used to deflect the web W closer to the guiding device 3, and the actual cutting contact with the blade is arranged by moving the guiding device 3 towards the web.

Figure 8:
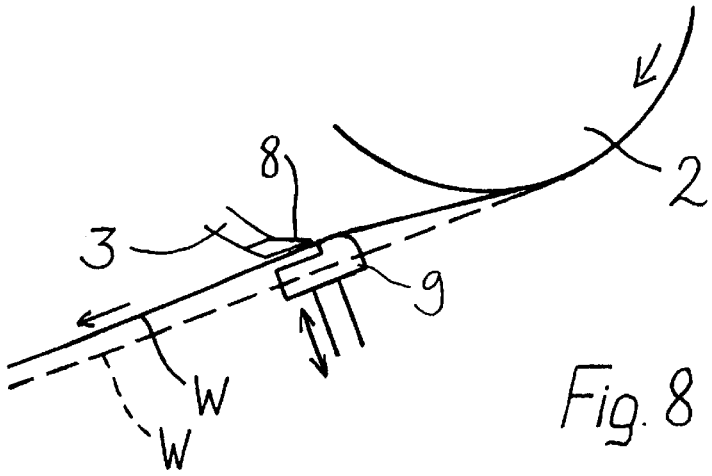
FIG. 8 shows an alternative implementation of the change device of FIG. 7.

FIG. 8 presents an embodiment in which the cutting is effected by co-operation of the cutting blade located at the tip of the guiding device 3 and the deflector device 9. The tip of the cutting blade is directed against the travel direction of the web so that the direction of action of its cutting edge forms a narrow acute angle, advantageously less than 30 degrees, with the departure direction of the web. The deflector device 9 ends in a threshold which descends steeply away from the web and behind which there is immediately the cutting edge of the cutting blade. The guide surface pushes the web from underneath to the level of the cutting blade. After the guide surface, i.e. on the next lower level after the threshold, opposite to the cutting blade on the other side of the web, the deflector device can be provided with a counter surface which the lower side of the blade hits after the cutting.

It was presented above that the cutting device 8 is a stationary full-width cutting blade. However, it is possible to equip the alternatives of FIGS. 6 and 7 also with a full-width cutting blade which performs a cutting stroke, wherein corresponding actuators for performing the cutting stroke are also placed in the guiding device 3.

Figure 9:
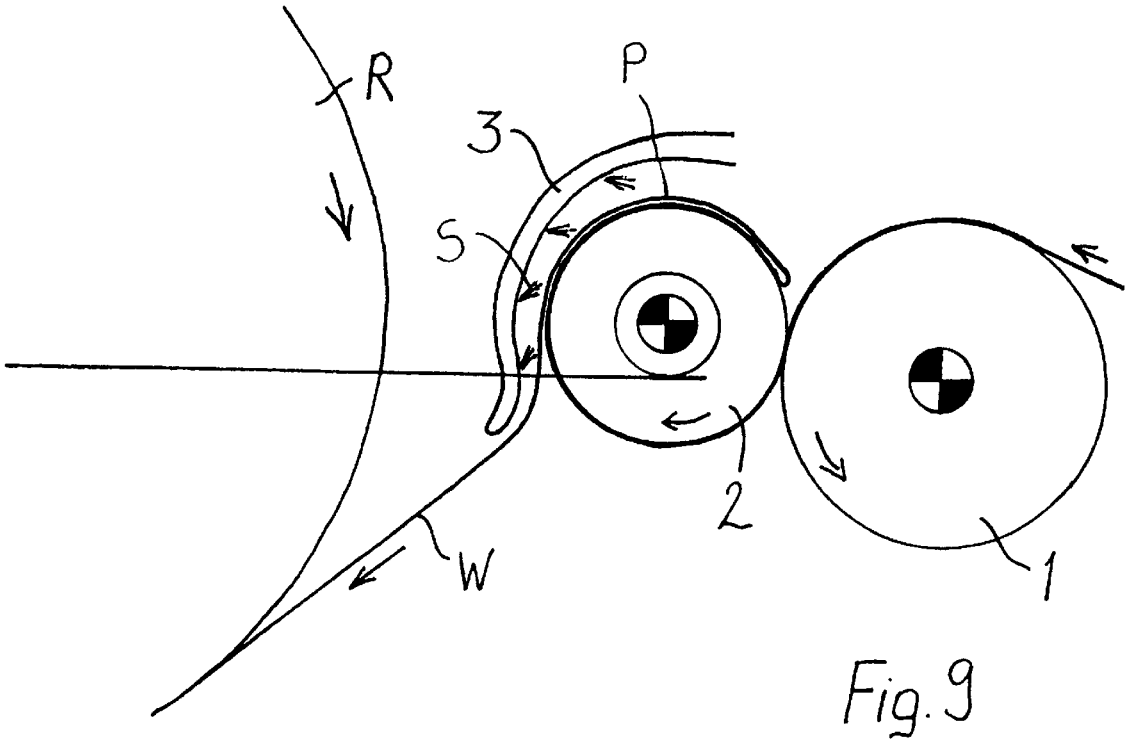
FIG. 9 shows the use of the change device in a bag exchange.

In the specification above, the main prerequisite for the exchange is that the web is cut off with a cutting blade to enable the exchange. However, the invention is not limited solely to a particular way of cutting off the web. The invention can also be used to implement a controlled bag exchange. FIG. 9 shows a method for conducting such a controlled bag exchange. A bag P, which is produced in the web in a known manner with difference between the decelerated surface velocity of the full roll R and the surface velocity corresponding to the production rate of the reel-up (reeling cylinder 1), is brought in a controlled manner against the reel spool 2 by means of air blowings of the guiding device 3. The bag is formed between the reel spool 2 and the guiding device 3, and by means of the above-described air jets S it is urged to lie flat against the mantle of the reel spool 2 so that the section located against the reel spool 2 rotating at the surface velocity of the reel-up (reeling cylinder 1), and the outer section running to the roll rotating at a lower surface velocity, are against each other. The cutting/tear mark will become straighter, and a strong jerk will not be transmitted to the roll to be completed to such a degree as at present, because the web W to be broken is tightened onto the mantle surface of the reel spool 2, and it is broken near the closing nip between the reel spool 2 and the reeling cylinder 1. Furthermore, during the cutting, cutting scrap, i.e. "chaff" is not separated from the web W to the same extent as when the bag is wound without guidance around the reel spool 2. Moreover, the web W remains in a straighter position during the bag exchange, wherein fewer side shifts and less surface broke are developed in the machine reel R to be completed. The controlled bag exchange enables the application of the bag exchange also to heavier paper grades than before. To guide the bag around the reel spool 2, it is possible to use air blowings directed from the opposite side of the web. Furthermore, it may be necessary to form the gap between the guiding device 3 and the reel spool 2 as a widening gap towards the web in its inlet end, so that the bag can be guided between the reel spool 2 and the guiding device 3.

With the invention, it is possible to make the new edge of the web to turn up in full width around the new reel spool 2 by means of different cutting methods, and with the air jets issued from the guiding device 3, it is possible to guide especially heavy paper grades in such situations. Thanks to the invention, the exchange efficiency is increased as the exchange breaks are reduced, broke caused by the exchanges is reduced and exchanges are cleaner in appearance. Furthermore, the guiding device 3 operates without accurate timings, because when it is in the guiding position, the air jets S can be kept in operation even before the cutting off of the web, and they can be kept operative even when the web is already wound several layers around the reel spool. Similarly, possible liquid sprays D can be started a moment before the web is cut off, wherein they wet the surface of the reel spool and make it more adhesive for the leading end of the web.

The flow rates of the air jets S and J can be affected by the air pressure used and by the dimensioning of the nozzles 3*b*. It is advantageous to arrange the speeds of the air jets at least equal to the speed of the paper machine, i.e. the travel velocity of the web W in the reel-up.

The invention is applicable to all paper grades that can be reeled up irrespective of their basis weight, i.e. grammage. Thus, in this context, the term paper web refers to all continuous, web-like materials, which are made from fibrous material and can be reeled up, irrespective of the basis weight.

What is claimed is:

1. A change device for a guiding a paper web from an old roll to a new roll in a continuously operating reel-up of a paper machine. said change device comprising:

a reel spool functioning as a core for a new roll, said reel spool having a circumferential surface;

a reeling cylinder structured and arranged to define a nip between said reeling cylinder and said reel spool and a cutting device structured and arranged to cut the web between said old roll and said nip;

a guiding device arranged in connection with said reel spool, said guiding device comprising a plurality of nozzles structured and arranged to direct air jets substantially over the full width of a paper web winding onto said reel spool for guiding the web around said reel spool, and said guiding device being located opposite to the circumferential surface of the reel spool and facing a sector of the reel spool which is free from the web before the exchange.

2. A change device according to claim 1, wherein said plurality of nozzles are arranged so that they direct said air jets towards the circumferential surface of said red spool.

3. A change device according to claim 1, wherein at least one of plurality of nozzles are structured and arranged to direct said air jet toward a surface of said guiding device for establishing a Coanda effect.

4. A change device according to claim 1 wherein said plurality of nozzles comprises a first plurality of nozzles structured and arranged to direct air jets towards said guiding device to establish a Coanda-effect and a second plurality of nozzles structured and arranged to direct air jets towards the circumferential surface of said reel spool.

5. A change device according to claim 1, wherein a surface of said guiding device is arranged opposite to the circumferential surface of said reel spool and said surface corresponds to a curvature of said circumferential surface over a sector $\alpha$ of a selected length.

6. A change device according to claim 1, further comprising means for directing the liquid spray towards the circumferential surface of said reel spool.

7. A change device according to claim 1, wherein said guiding device comprises a blow box.

8. A change device according to claim 1, further comprising an actuator for moving said guiding device into an operating position near said reel spool and a rest position away from said reel spool.

9. A change device according to claim 1, wherein said guiding device is coupled to said reel spool.

10. A change device according to claim 1, wherein said cutting device is structured and arranged to act on an opposite side of the web relative to the side of the web that said guiding device acts on.

11. A change device according to claim 1, wherein said cutting device is coupled to said guiding device and said cutting device is structured and arranged to act on a same side of the web as said guiding device.

12. A change device according to claim 1, wherein said cutting device is structured and arranged to cut said web along a full width of said web.

13. A method for changing a roll in a continuous reel up of a paper machine comprising the steps of:

placing a new reel spool having a circumferential surface in a change position to define a nip between a reeling cylinder and said new reel spool;

cutting a web running onto an old roll after said nip;

guiding a leading end of said cut web onto said new reel spool forming the core of a new roll;

wherein said leading end of said cut web is guided onto said reel spool along a substantially full width of the web by means of jets of air acting opposite to the circumferential surface of the reel spool over a sector of the reel spool which is free from the web in the change position before the exchange.

14. A method according to claim 13, wherein said jets of air are directed toward the circumferential surface of said reel spool.

15. A method according to claim 13, further comprising establishing a Coanda effect by means of said jets of air on a carrier surface for guiding said leading end around said reel spool.

16. A method according to claim 13, further comprising directing said jets of air towards the circumferential surface of said reel spool and generating a Coanda effect by means of said jets of air for guiding said web around said reel spool.

17. A method according to claim 13, further comprising setting a velocity of said jets of air to a speed corresponding to an operating speed of said paper machine.

18. A method according to claim 13, further comprising moving said old roll away from the reeling cylinder prior to said cutting step and wherein said cutting step comprises cutting a portion of web that extends from said reeling cylinder to said old roll.

19. A method according to claim 18, wherein said cutting of said portion of web that extends from said reeling cylinder to said old roll is performed on a side of the web opposite to the side of the web upon which said jets of air are located before the cutting.

20. A method according to claim 18, wherein said cutting of said portion of web that extends from said reeling cylinder to said old roll is performed on a side of the web which is the same side of the web upon which said jets of air are located before the cutting.

21. A method according to claim 18, wherein said cutting of said portion of the web is performed by a blade cutter.

22. A method according to claim 13, further comprising passing said web onto said reel spool by means of a bag exchange so that a bag formed from said web is guided onto said reel spool by means of said jets of air.

* * * * *